United States Patent [19]

Fujiwara et al.

[11] 4,433,925

[45] Feb. 28, 1984

[54] MANUALLY-OPERATED DOT PRINTER FOR POCKET SIZED CALCULATORS

[75] Inventors: Hitoshi Fujiwara; Masanao Matsuzawa, both of Shiojiri, Japan

[73] Assignees: Epson Corporation, Nagano; Kabushiki Kaisha Suwa Seikosha, Tokyo, both of Japan

[21] Appl. No.: 320,046

[22] Filed: Nov. 10, 1981

[51] Int. Cl.[3] ..... B41J 3/36

[52] U.S. Cl. ..... 400/88; 400/121; 400/314; 400/317.2; 400/320; 400/338; 400/636; 400/705.1

[58] Field of Search ..... 400/88, 314, 317.2, 400/323.1, 120, 124, 121, 320, 126, 705.1, 337, 338, 338.1, 338.2, 636

[56] References Cited

U.S. PATENT DOCUMENTS

| | | | |
|---|---|---|---|
| 3,767,020 | 10/1973 | Rowe | 400/124 |
| 3,826,915 | 7/1974 | Giolitti et al. | 400/121 X |
| 3,831,727 | 8/1974 | Kruspe et al. | 400/126 |
| 3,881,587 | 5/1975 | Okabe | 400/121 X |
| 4,310,256 | 1/1982 | Inoue | 400/317.2 X |
| 4,350,456 | 9/1982 | Noda | 400/705.1 X |

FOREIGN PATENT DOCUMENTS

| | | | |
|---|---|---|---|
| 2523691 | 12/1976 | Fed. Rep. of Germany | 400/338 |
| 2939206 | 4/1981 | Fed. Rep. of Germany | 400/88 |
| 56-67282 | 6/1981 | Japan | 400/88 |
| 2078616 | 1/1982 | United Kingdom | 400/88 |

*Primary Examiner*—Clifford D. Crowder

*Attorney, Agent, or Firm*—Blum, Kaplan, Friedman, Silberman and Beran

[57] ABSTRACT

A manually operated dot printer designed for use in a pocket sized calculator or a small sized electronic device includes a printing head which is manually movable across a sheet of printing paper in one direction. A pulse generating circuit produces a signal in synchronization with the speed of travel of the printing head. While the printing head is moving in said one direction, the printing head effects electrically controlled printing operations with dots in response to the signal produced by the pulse generating circuit. As the printing head is advanced, spring means store energy which is applied to return the printing head and advance the printing paper.

4 Claims, 11 Drawing Figures

FIG. 1a
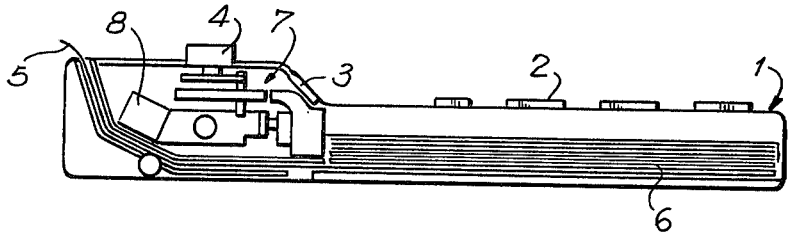
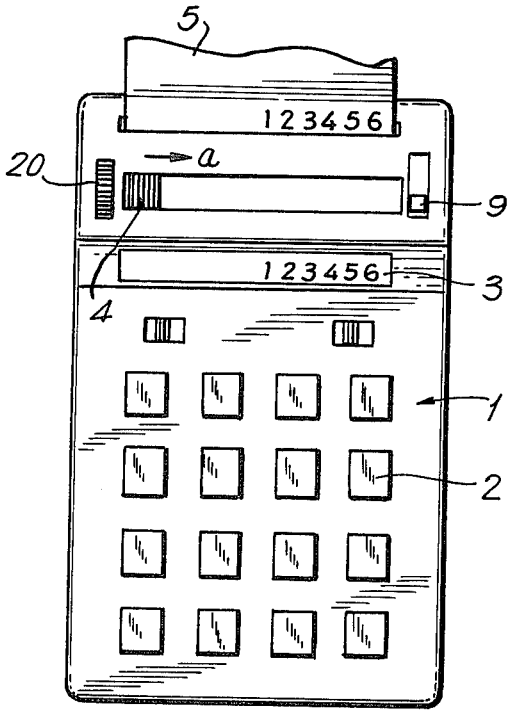
FIG. 1b

FIG. 2d
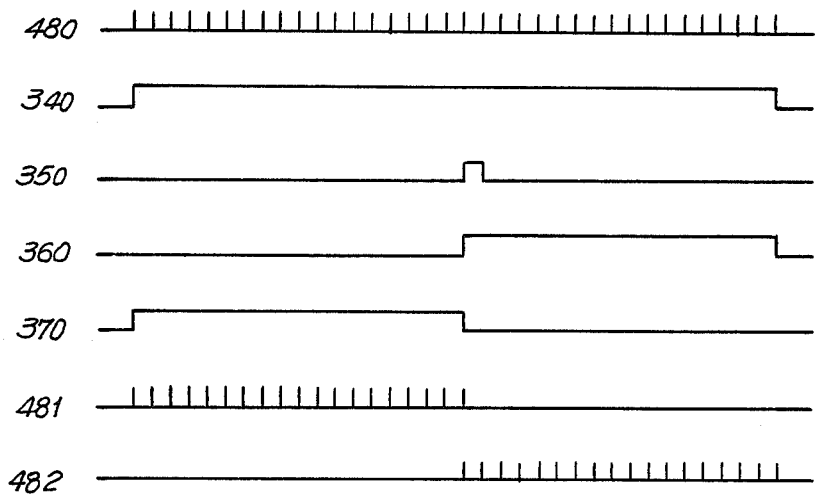
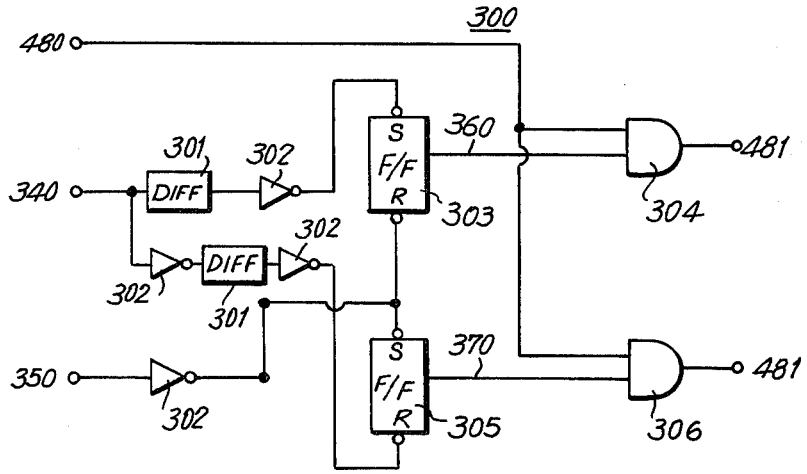
FIG. 2e

MANUALLY-OPERATED DOT PRINTER FOR POCKET SIZED CALCULATORS

BACKGROUND OF THE INVENTION

This invention relates generally to a printer applying a matrix of dots on a recording paper to form characters and more particularly to a manually operated dot printer designed for low power consumption. Manually operated printers, as represented by Japanese Utility Model Laid Open Publication No. 55-53244, effect printing under pressure, or drive a printing wheel with energy stored in a spring as a result of applied pressure. Such printers require two or three SUM-3 cells for generating energy to select characters on the printing wheel in addition to the manually produced energy. Thus such printers cannot be incorporated into a pocket sized calculator. A pocket sized calculator with a printer of the discharge printing type, or thermal printing type, consumes a large amount of electrical energy necessary for moving the printing head and feeding the printing paper. Thus such a printer requires frequent replacement of cells, a disadvantage which renders this type of calculator unsatisfactory from the viewpoint of practicality.

What is needed is a dot printer of small size, suitable to be carried in a pocket, and using low power to produce good quality printing.

SUMMARY OF THE INVENTION

A printing head of a manually operated dot printer is manually moved in one direction across a sheet of printing paper and simultaneously a printing operation is effected to produce dots on the printing paper. A pulse generating circuit produces a signal in synchronization with movement of the printing head in said one direction, and the printing head is responsive to the signal so as to print desired characters and symbols on the sheet of printing paper. Spring means are provided for storing energy while the printing head is manually moved, and means are provided for feeding the sheet of printing paper with the energy thus stored.

Accordingly, it is an object of this invention to provide an improved method and apparatus for a manually operated dot printer which operates with low electrical power consumption and is suitable as a pocket sized calculator.

Another object of this invention is to provide an improved method and apparatus for a manually operated dot printer for use in a low profile pocket sized calculator, or small sized electronic device, drivable by a silver cell, the dot printer being actuatable manually or with energy stored by manual operation, except for the printing operation which is electrically controlled.

A further object of this invention is to provide an improved method and apparatus for a manually operated dot printer having a printing head movable by manual force at a constant speed for high printing quality and low power consumption.

Still another object of this invention is to provide an improved method and apparatus for a manually operated dot printer capable of non-mechanical dot printing operation using a discharge, thermal, laser or ink jet method for low power consumption.

Still other objects and advantages of the invention will in part be obvious and will in part be apparent from the specification.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1*a* is a side sectional view of a pocket size calculator incorporating a manually operated dot printer in accordance with the invention;

FIG. 1*b* is a plan view of the pocket size calculator of FIG. 1*a;*

FIG. 2*d* is a timing chart of signals associated with operation of the printer of FIG. 2*a–c;*

FIG. 2*e* is a functional block diagram of a pulse generating circuit for the timing chart of FIG. 2*d;*

DESCRIPTION OF THE PREFERRED EMBODIMENTS

Figure 2B:
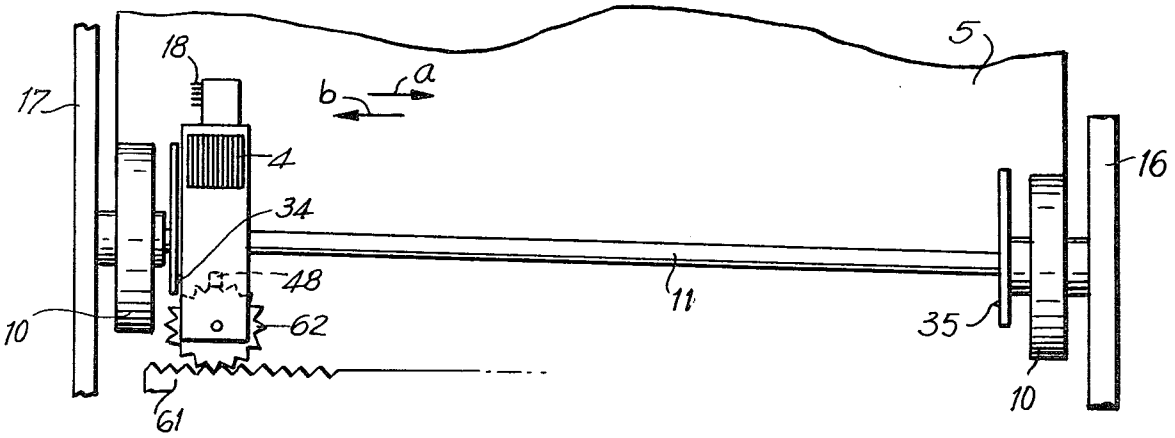
FIG. 2*b* is a partial plan view of the manually operated dot printer of FIG. 2*a;*

With reference to FIGS. 1*a*, 1*b*, and electronic calculator 1 comprises a keyboard 2, display 3, a manually actuatable knob 4 for manually driving a dot printer 7 incorporated within the calculator 1, and a sheet of printing paper 5 on which characters are printed by the manually operated dot printer 7 within the calculator 1. Also included in the calculator 1 is fan-folded paper 6 as a storage of the printing paper 5, and a printing head 8, which is a portion of the manually operated dot printer 7, having low power printing elements of the discharge, thermal or ink jet type thereon. The particular type of low power printing elements is not a novel portion of this invention and accordingly requires no detailed description herein.

In operation, selected keys on the keyboard are depressed for calculation of data in the electronic calculator 1 and calculated results are indicated on the display 3, which for example, may be of the liquid crystal type. When such calculator results are to be recorded on the paper sheet 5, the manual knob 4 is manually moved in the direction of the arrow a and printing on the paper is effected during that motion. When the knob 4 is released at the end of the motion in the direction a, the print head 8 and manual knob 4 are caused to return to the starting position and the printing paper 5 is fed along by paper feed means. When it is required to feed the fanfolded paper 6 to a position in which printing is to be effected, the knob 4 may be moved to feed the paper with the movement of the printing head while the latter carries out no printing, or a step paper feed knob 9 or a continuous paper feed knob 20 may be manually turned. For rapid feeding of the paper, it is more convenient to actuate the paper feed knob 20.

Manually operated dot printers and a method in accordance with this invention are described with reference to FIGS. *2a* through 6. As shown in FIGS. *2a, 2b,* a manually operated dot printer in accordance with the invention comprises a manually actuatable knob 4, a printing head 8, a paper feed roller 10 for feeding a sheet 5 of printing paper, a guide shaft 11 on which the printing head 8 is movable, and a pressure roller 19 for pressing the sheet 5 against the paper feed roller 10. The dot printer also includes a first reed switch 34 for producing a pulse indicative of the start of a printing operation, and a second reed switch 35 for producing a pulse indicative of the termination of the printing operation. The printing head 8 is movable manually, as by a finger 60 applied to the knob 4.

A toothed guide rack 61 in a fixed position on a frame member (not shown) of the printer, is held in meshing engagement with a gear 62 rotatably supported on the printing head 8 to allow the printing head to move in one direction. The printing head 8 includes a detector 48 for generating timing pulses 480 (FIG. *2d*) in synchronization with movement of the printing head 8 between the side frames 17, 16 while the gear 62 rotates in mesh with the guide rack 61.

When it is desired to effect recording of a printed character on the paper 5, the knob 4 is moved, as by a finger 60, in the direction of the arrow a. Motion of the printing head 8 in the direction a actuates the reed switch 34 to generate a print starting pulse 340 (FIG. *2d*) for permitting subsequent printing operation. During the period of the print starting pulse 340, the detector 48 generates timing pulses 480 at intervals, each interval equaling the space for one printed dot, or one printed dot multiplied by an integer n. The timing pulses 480 are generated in synchronization with the movement of the printing head 8. Even when the printing head 8 is moved at varying speeds, a pulse generating circuit 300 (FIG. *2e*) produces a train of printing pulses 481, 482 on the basis of the timing pulses 480 in synchronization with the travel of the printing head 8. Thus characters and symbols are printed at regular pitch distances in spite of variations in the speed of travel of the printing head 8.

When the printing head 8 reaches the second reed switch 35 after the printing head 8 has completed the printing operation, the second reed switch 35 is actuated to produce a print ending pulse 350 and, at the same time, the printing process of the head 8 is stopped.

Figure 2C:
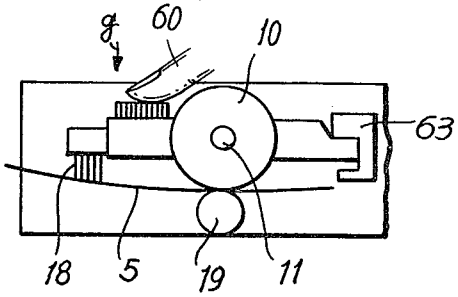
FIG. 2*c* is a partial side elevational view of an alternative embodiment of a manually operated dot printer in accordance with this invention.
Figure 2A:
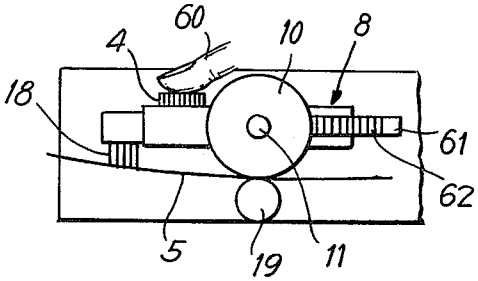
FIG. 2*a* is a partial side elevational view of a manually operated dot printer in accordance with the invention.

The printing operation is finished and the printing head 8 starts moving back to the original position. The printing head 8 may be returned in the direction of the arrow b by either the finger 60 applied to the knob 4 or by means of a return spring (not shown in FIG. 2) which has been extended during head motion in the direction a. While the printing head 8 is moving back, the sheet 5 of printing paper is fed along, that is, advanced by the paper feed roller 10. The knob 4 may be actuated by a suitable writing instrument or means other than the finger 60.

In accordance with an alternative embodiment as shown in FIG. *2c,* a guide 63 is provided in place of the guide rack 61 and the gear 62 of the embodiment of FIG. *2b,* to guide the printing head 8 as the latter moves along the guide shaft 11. In operation, the printing head 8 is moved by a finger 60 in the direction of the arrow a (FIG. *2b*) while printing elements 18 are pushed by the finger 60 downwardly in the direction of the arrow g in to contact with the sheet 5. The first reed switch 34 is actuated to produce a print starting pulse 340. As the printing head 8 travels, a pulse generator on the guide 63 produces a train of timing pulses 480 each corresponding to at least one printing dot in synchronization with the movement of the printing head 8. The timing pulses 480 thus generated enable the printing device 18 to print necessary characters and symbols on the sheet 5 of recording paper at regular pitch intervals regardless of variations in the speed of movement of the printing head 8. After the printing operation has been finished, the printing head 8 arrives at the second reed switch 35 which is then actuated to stop the printing by the head 8. Thereafter, the printing head 8 is caused, either manually or by a spring, to return to the starting position. The sheet 5 of printing paper is fed along in the manner described above.

While in the illustrated embodiment, printing is effected by printing pulses 481 which are produced, as explained hereinafter, during an interval starting with actuation of the first reed switch 34 and ending with actuation of the second reed switch 35, in an alternative embodiment, a series of printing pulses 482 may be generated for controlling the printing operation during a period starting with actuation of the second reed switch 35 and ending with deactivation of the first reed switch 34.

The pulse generating circuit 300 for producing the pulses 481, 482 is described with reference to FIGS. *2d, 2e.* The first reed switch 34 while being actuated produces the pulse signal 340. The second reed switch 35 when actuated produces the pulse signal 350, and the detector 48 produces the timing pulse signals 480. The pulse generating circuit 300 comprises differentiating circuits 301, inverters 302, a first flip flop 303, a first AND gate 304, a second flip flop 305, and a second AND gate 306. These circuit components are connected as illustrated in FIG. *2e.*

In operation, the high signal 340 is applied through the differentiating circuit 301 and the inverter 302 to a set terminal S of the first flip flop 303. The low signal 350 is applied through the inverter 302 to a reset terminal R of the first flip flop 303, whereupon the flip 303 produces a signal 360 as an output. The signal 360 and the timing signal 480 are applied to the inputs of the first AND gate 304, which then outputs the printing pulses 481 to drive the printing elements 18. Similarly, the second flip flop 305 generates a signal 370, and the signal 370 and the timing signal 480 are supplied as inputs to the second AND gate 306 which generates the printing pulses 482 as an output to the printing elements 18.

Whereas the pulse generating circuit 300 has been shown as comprising flip flops, AND gates and other components, it will be apparent to those skilled in the art that other components and circuit arrangements than those illustrated may be employed to achieve the same circuit operation.

The printing elements 18 in the dot printer have been shown to be of the discharge printing type which consume a small amount of electric power and hence can be adequately powered by a silver cell. Other low power printing techniques can be used effectively.

FIGS. 3–6 illustrate a manually operated dot printer constructed in accordance with an alternative embodiment of the invention. The dot printer includes a paper feed roller 10 against which a sheet of printing paper 5 is pressed by a pressure roller 19, a guide shaft 11 on which the printing head 8 is movable, and a paper feed shaft 12 having a paper feed ratchet wheel mounted thereon for incrementally rotating the paper feed roller 10. The shafts 11, 12 are coaxial with each other.

A paper feed pawl 14 is mounted on a paper feed member 15 for angularly moving the ratchet wheel 13 one pitch interval at a time. Side frames 16, 17, shafts and subframes jointly comprise an overall frame for the printer. Printing elements 18 in the printing head 8 may comprise electrodes for a dot discharge method, or heater elements for a thermal method of printing. A paper feed drive shaft 23 serves to guide a slide 45 for moving the printing head 8, and a paper feed spring 37 serves to drive the paper feed member 15 and to incrementally rotate the paper feed shaft 12. A spring 41 prevents the paper feed ratchet wheel 13 from rotating backwards, and the sheet 5 of printing paper is guided by paper guides 30, 31. The print head 8 is able to translate along the guide shaft 11 and is also capable of pivoting with the longitudinal axis of the guide shaft 11 as the center of rotation.

A printing head body 40 which includes the printing head 8, travels on and along the guide shaft 11 with the movement of the manual knob 4. A gear 24 is rotatably mounted on a support shaft 25 which is in mesh with a toothed rack 57 having a fixed position relative to the frame of the printer. The gear 24 has twenty teeth in the illustrated embodiment. A gear 26 is rotatably mounted on a support shaft 29 and is in mesh with gear 24. The gear 26 has ten teeth in the illustrated embodiment. A gear 27 with ten gear teeth is mounted on the same support shaft 29 for rotation with gear 26.

An ankle or rocker 49 has pawls 32 engageable with the gear 27. A slide guide member 44 serves to guide a slide 45, for allowing sliding movement of the printing head 8, which supports a guide pin 46 through a guide spring 47. A detector means 48 detects, with a detector bar 33, the reciprocating movement of the rocker 49 about the shaft 25 for producing pulses. Each pulse corresponds to one dot interval of motion by the printing elements 18, allowing the printing head to be manually moved in synchronization with printing operation.

A guide plate 50 (FIG. 6) has guide grooves for guiding the guide pin 46. The guide groove 53 receives the guide pin 46 when the printing head 8 is in a standby position. The guide pin 46 moves along the guide groove 51 to the guide groove 54 while the printing head 8 is moved manually in the direction of the arrow a (FIG. 5) by the manual knob 4. Printing can be effected during the time when the printing head is moved in the direction a. The guide groove 52 allows the printing head 8 to return to the standby position under the force of a return spring 28 which is extended when the printing head 8 moves in the direction of a and which contracts when the printing head 8 moves in the direction b. The guide groove 51 has a plurality of stops 55 cut therein to prevent the printing head 8 from returning to the standby position unless and until the guide pin 46, connected to the printing head 8 reaches the return starting groove 54.

The manually operated dot printer thus constructed operates as follows. When it is desired to record on paper the results or procedures of calculation in the electronic calculator 1, the manual knob 4 is manually moved in the direction of the arrow a to start operation of the dot printer. As the manual knob 4 is thus moved, the printing head body 40 is caused to travel along the guide shaft 11 while at the same time the guide pin 46 moves from the groove 53 via the upper groove 51 to the groove 54. With the start of motion of the printing head 8, the first reed switch 34 disengages from the printing head body 40 and generates a print starting pulse which permits the printing head 8 to effect printing until the guide pin 46 reaches the guide groove 54. While the guide pin 46 moves by manual force from the groove 51 to the groove 54, the printing head 8, as it travels, is maintained in contact with or closely adjacent to the printing paper 5. When the guide pin 46 arrives at the guiding groove 54, the second reed switch 35 is engaged by the printing head body 40 and produces a print ending pulse for completing the printing operation.

Figure 3:
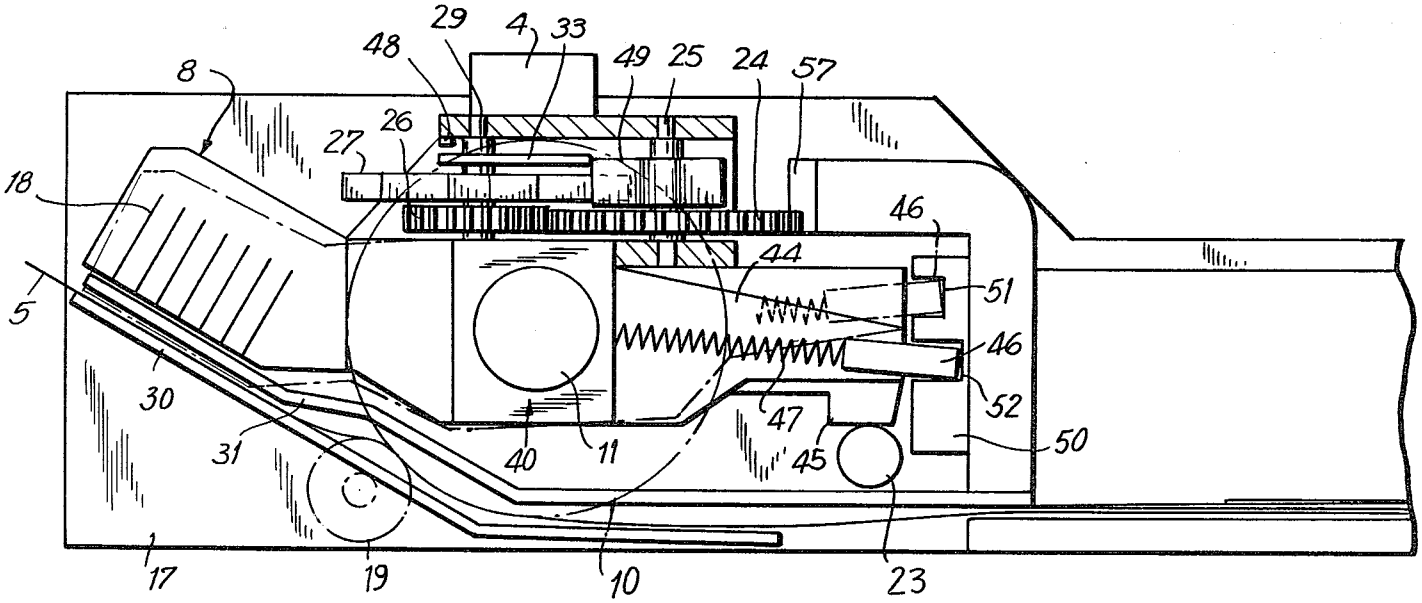
FIG. 3 is a partial left side elevational view of an alternative embodiment of a manually operated dot printer in accordance with this invention.
Figure 4:
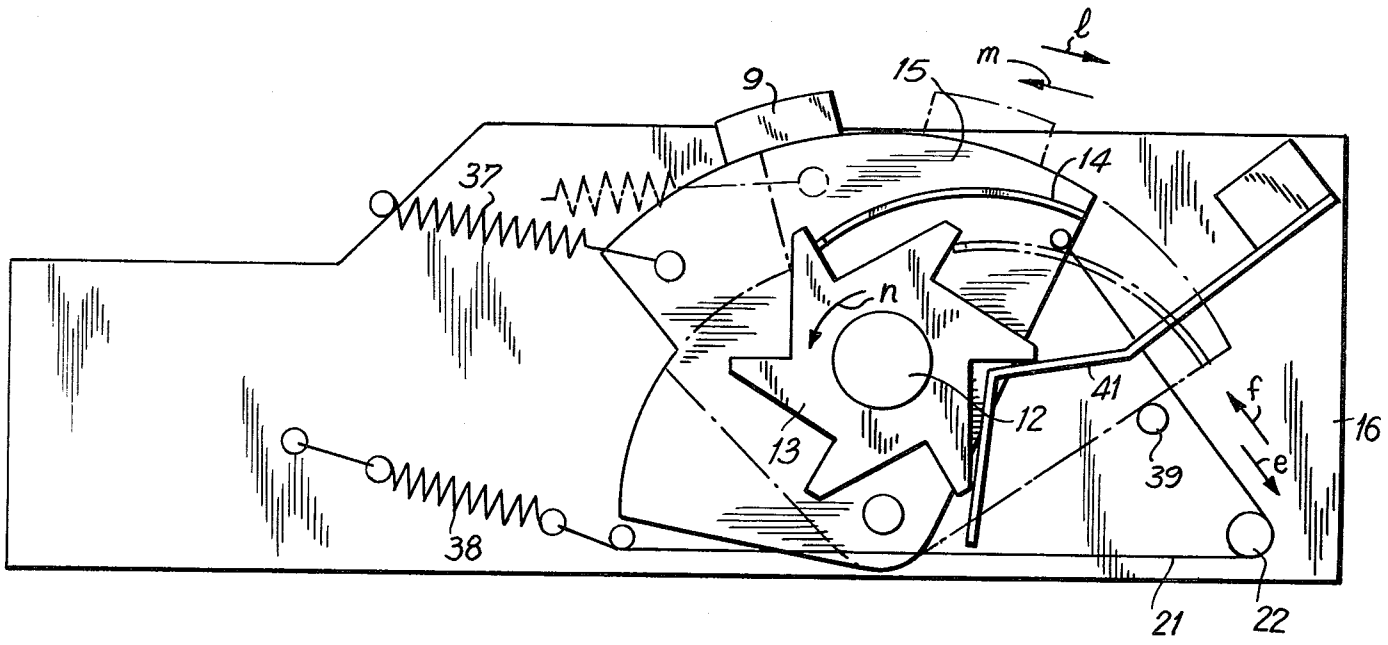
FIG. 4 is a partial right side elevational view of the dot printer of FIG. 3.
Figure 5:
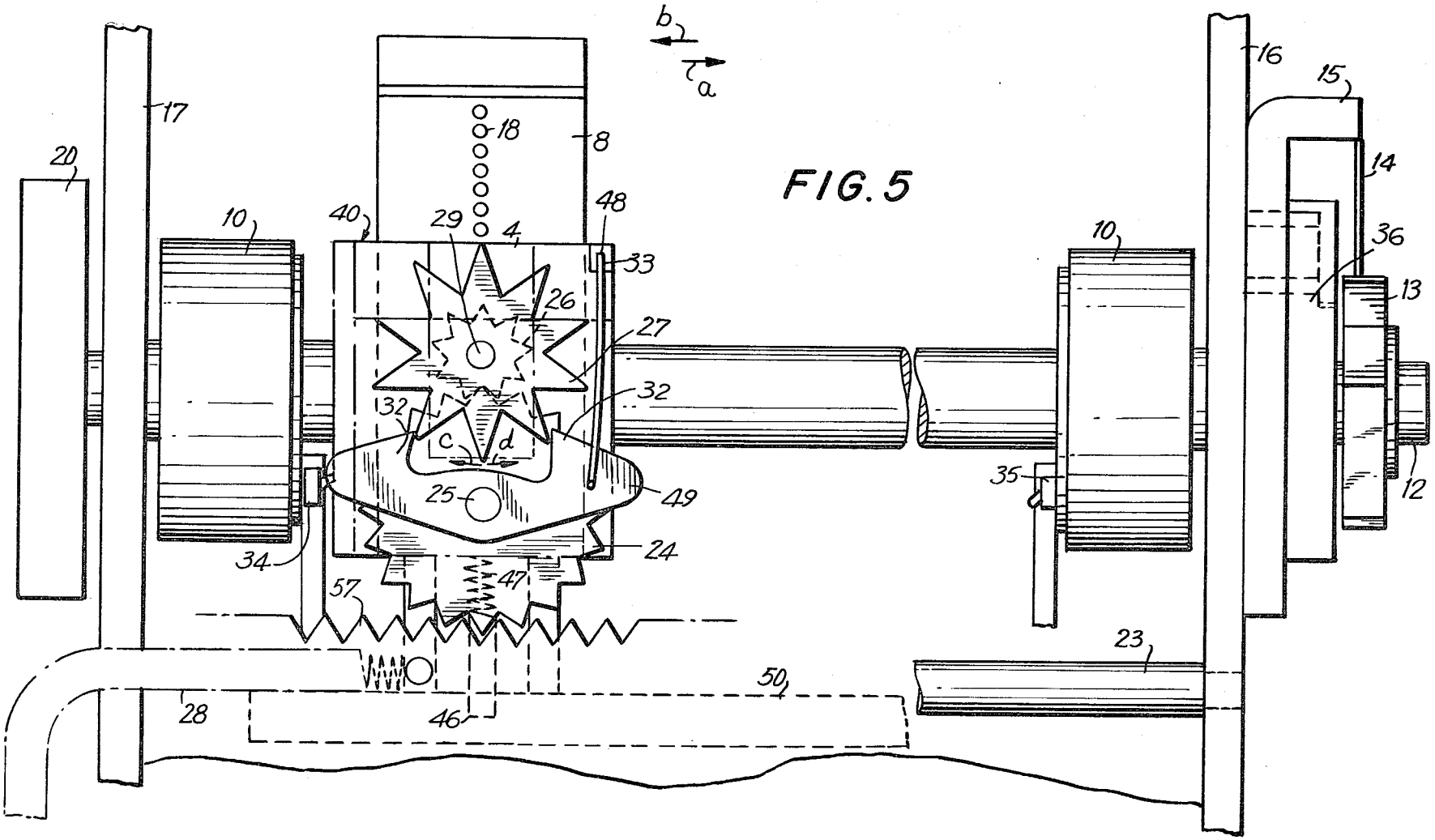
FIG. 5 is a partial plan view of the manually operated dot printer of FIG. 3.
Figure 6:
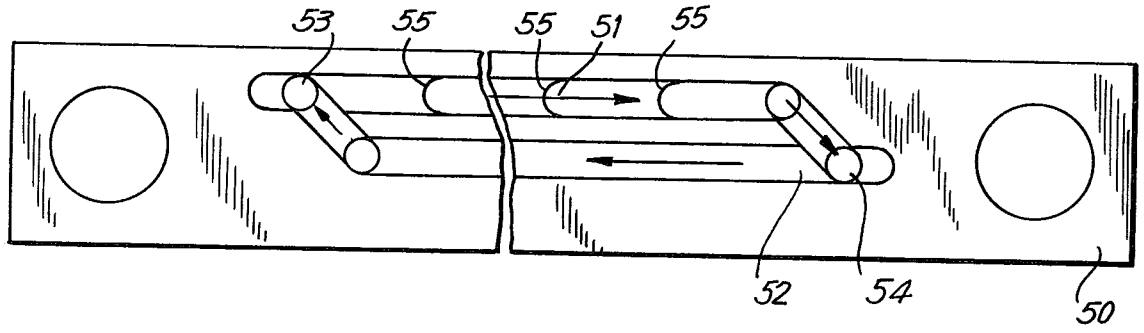
FIG. 6 is a partial rear view of the manually-operated dot printer of FIG. 3.

When the printing head body 40 is released from the manual force, and the guide pin 46 is caused by the return spring 28 to move from the groove 54 via the lower groove 52 to the groove 53, the printing head 8 is maintained out of contact with the printing paper 5 under control of the guide pin 46 and these grooves. As best seen in FIG. 3 when the guide pin 46 (broken lines) is in the upper guide groove 51 the print head 8 is pivoted about the longitudinal axis of the shaft 11 such that the printing elements 18 (broken lines) are close to the paper 5. On the other hand, when the guide pin 46 is in the lower groove 52 the print head 8 is pivoted (solid lines) such that printing elements 18 are spaced away from the paper 5.

With the stops 55 in the groove 51, the printing head body 40 is prevented from returning along the groove 51 under the force of the return spring 28. There is no return for the printing head body unless the guide pin 46 is manually moved to the groove 54.

When the printing head body 40 is manually moved in the direction of the arrow a, the gear 24 rotates by its meshed engagement with the rack 57. Rotation of the gear 24 causes the gears 26, 27 to rotate whereupon the rocker 49 moves back and forth about the shaft 25 in the directions indicated by the arrows c and d. The movement of the rocker 49 acts as a braking force against the manual force exerted to move the printing head 8 forward. That is, the motion in the direction of a is restricted as the rocker 49 moves back and forth to engage one tooth after the other on the gear 27. Thus, the speed of motion on the printing head in the direction a is variable in accordance with the force applied but the motion is constrained and not free. The oscillatory motion of the rocker 49 causes the detector bar 33 to reciprocate thereby enabling the detector means 48 to generate a signal indicative of the print timing. The print timing thus detected by the detector means 48 is in synchronization with the timing in which the printing head 8 is manually moved. Printed dots are thus spaced at substantially equal intervals regardless of variations in the speed of travel of the printing head 8. Thus, characters comprised of such dots are neatly printed.

When the knob 4 is released, the printing head body 40 begins to move in the direction of the arrow b under the force of the return spring 28. The rocker pawls 32 alternately engage the teeth of the gear 27 to thereby cause the rocker 49 to be angularly moved back and forth, that is, oscillated in the direction of the arrows c, d. The printing head is thus allowed to return at a substantially constant speed of travel to the standby position. Intermittent stepwise movement of the printing head body 40 can be made smoother by attaching a resistance body, such as a pad, to the rocker 49.

During printing operation, the printing elements 18 are held in contact with or close to the printing paper 5 as shown by the broken lines in FIG. 3 while the printing head 8 is moving. The printing elements are selectively supplied with driving pulses for printing each time the printing head is moved one increment so as to print a character with a plurality of printed dots, for example, in a five×seven dot matrix. Upon release of the manually applied force on the knob 4, the printing head 8 returns incrementally under the action of the pawls 32 while it is held in the upper position (solid lines) of FIG. 3, because the pin 46 slides along the lower groove 52. The printing head 8 is thus moved back stepwise through increments each corresponding to one dot interval while the printing elements 18 are kept away from the printing paper 5. For a pocket-sized calculator, the printing elements 18 may be of any known low power consumption type such as, for example, discharge, thermal, laser or ink jet printing elements.

The printing paper 5 on which printing has been effected is fed out of the calculator by rotation of the paper feed shaft 12 through a given angle. Rotation of the shaft 12 rotates the paper feed roller 10. Such a paper feeding operation is described in more detail with reference to FIG. 4. Actuation of the knob 4 to move the printing head body 40 in the direction of the arrow a (FIG. 5) causes a wire 21 connected to the printing head body 40 and extending around a roller 22 to move the paper feed member 15 in the direction of the arrow l the printing operation is performed. When the paper feed member 15 engages a stop 39, a spring 38 connected to the wire 21 resiliently allows the printing head body 40 to continue in its further motion. At this time, the paper feed member 15 is in the position shown in FIG. 4 with broken lines. The spring 37 is stretched in the process of rotating the paper feed member 15.

A pawl 14 attached to the paper feed member 15 is engaged with a tooth of the ratchet wheel 13. When the paper feed member 15 is angularly rotated in direction l as described above, the pawl 14 is drawn to the position where it engages the next tooth of the ratchet wheel 13 as indicated in the broken lines of FIG. 4. When the manual knob 4 is released from the applied force after printing has been effected, the paper feed member 15 is caused to move back in the direction indicated by the arrow m due to the elastic forces exerted by the spring 37. In the process, the paper feed pawl 14 rotates the ratchet wheel 13 by an angle representing one tooth or pitch. Thereby the paper feed member 12 is rotated through an angle in the direction of the arrow n. Thus, the paper feed roller 10 feeds the printing paper 5 on which printing has been effected by a predetermined increment.

When it is desired to feed the printing paper 5 manually regardless of printing operation, the paper feed knob 9 is manually moved in the direction l to allow the printing paper 5 to be fed along under the bias of the spring 37 in a manner as described above when the knob 9 is released. The foregoing paper feeding operation may be repeated for continuously feeding the printing paper 5. The printing paper 5 may be fed along in any desired increment by change in the number of teeth on the ratchet wheel 13, and the printing paper 5 may be fed in the opposite direction by changing the contour of the teeth of the ratchet wheel 13 and the shape of the spring 41 for preventing the ratchet wheel 13 from turning back.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawings shall be interpreted as illustrative and not in a limiting sense.

What is claimed is:

1. A printer for printing on a recording paper, comprising:

feed means for advancing said paper, said feed means including at least two separate feed rollers mounted on a feed shaft;

printing head means, said head means being mounted on said feed shaft for translation relative to said paper for printing a line of characters thereon, said printing head means being movable between said separate feed rollers;

means for translating said printing head means for said printing;

printing means mounted on said printing head means and moving therewith, said printing means being subjected to actuation for printing on said paper when said printing head means is moved relative to said paper.

2. A printer as claimed in claim 1, and further comprising spring means, said spring means being adapted to store energy when said printing head means is translated in one direction across said paper, said spring means translating said head means in the opposite direction and powering said feed means.

3. A printer as claimed in claim 2 wherein said printing means is electrically operated.

4. A printer as claimed in claim 3, wherein said print means is a dot printer.

* * * * *